US007444774B1

(12) United States Patent
Garcia et al.

(10) Patent No.: US 7,444,774 B1
(45) Date of Patent: Nov. 4, 2008

(54) FOLDABLE TRAFFIC SIGN

(75) Inventors: Guadalupe C. Garcia, Tijuana (MX); Bob L. Wielenga, Laguna Hills, CA (US)

(73) Assignee: Traffix Devices, Inc., San Clemente, CA (US)

( * ) Notice: Subject to any disclaimer, the term of this patent is extended or adjusted under 35 U.S.C. 154(b) by 0 days.

(21) Appl. No.: 11/396,352

(22) Filed: Mar. 30, 2006

Related U.S. Application Data

(60) Provisional application No. 60/666,816, filed on Mar. 30, 2005.

(51) Int. Cl.

| | |
|---|---|
| ***G09F 15/00*** | (2006.01) |
| ***G09F 15/02*** | (2006.01) |
| ***E01F 9/00*** | (2006.01) |
| ***A45D 19/04*** | (2006.01) |

(52) U.S. Cl. ..... 40/610; 40/607.04; 116/63 P; 116/63 R; 248/127

(58) Field of Classification Search ..... 40/610, 40/124.13, 613, 539, 903, 612; 116/63 R, 116/63 P; 248/130, 144, 150, 170, 188, 439
See application file for complete search history.

(56) References Cited

U.S. PATENT DOCUMENTS

| | | | | |
|---|---|---|---|---|
| 735,486 | A | | 8/1903 | Fels |
| 2,525,728 | A | | 10/1950 | Sauer |
| 2,613,463 | A | | 10/1952 | Transue |
| 3,200,786 | A | * | 8/1965 | Swezy et al. ..... 116/63 P |
| 3,254,434 | A | * | 6/1966 | Gintoft ..... 40/592 |
| 3,792,678 | A | | 2/1974 | Rowland |
| 4,019,271 | A | | 4/1977 | Latimer |
| 4,182,063 | A | | 1/1980 | Klosel |
| 4,548,379 | A | | 10/1985 | Seely et al. |
| 4,552,089 | A | | 11/1985 | Mahoney |
| 4,575,040 | A | | 3/1986 | Seely |
| 4,592,158 | A | | 6/1986 | Seely |
| 4,593,879 | A | | 6/1986 | Seely et al. |
| 4,619,220 | A | | 10/1986 | Seely et al. |
| 4,662,095 | A | | 5/1987 | Higgins |
| 4,691,892 | A | | 9/1987 | Grewe et al. |
| 4,694,601 | A | | 9/1987 | Dicke et al. |
| 4,747,515 | A | | 5/1988 | Kasher et al. |
| 4,977,697 | A | | 12/1990 | Genick |
| 5,340,068 | A | | 8/1994 | Sarkisian et al. |

(Continued)

*Primary Examiner*—Lesley D. Morris
*Assistant Examiner*—Syed A Islam
(74) *Attorney, Agent, or Firm*—Stout, Uxa, Buyan & Mullins, LLP; Donald E. Stout

(57) ABSTRACT

A foldable traffic sign system comprises a relatively rigid sign panel and a plurality of folding lines disposed in the sign panel, for permitting ready folding of the sign panel into a substantially smaller configuration. In a preferred embodiment, at least one cut is disposed partially along a dimension of the sign panel, to further facilitate ready folding of the sign panel. One of the folding lines is disposed substantially horizontally across a center region of the sign panel, and at least one of the folding lines is disposed substantially vertically on the sign panel, and intersects with the horizontal folding line. The plurality of folding lines creates a plurality of sign sections, preferably six, defined by a combination of the folding lines and cuts in the sign panel. The sign system further comprises a folding sign stand, and a tote for containing both the sign panel and sign stand.

10 Claims, 5 Drawing Sheets

U.S. PATENT DOCUMENTS

| | | | | |
|---|---|---|---|---|
| 5,488,792 | A | 2/1996 | Kwok | |
| 5,694,711 | A | 12/1997 | Cowgill et al. | |
| 5,725,186 | A | 3/1998 | Hillstrom et al. | |
| 5,732,911 | A | 3/1998 | Kulp et al. | |
| 5,829,178 | A | 11/1998 | Hillstrom | |
| 6,032,908 | A | 3/2000 | Hillstrom et al. | |
| 6,056,250 | A | 5/2000 | Hillstrom et al. | |
| 6,430,855 | B1 * | 8/2002 | Gertz et al. | 40/607.04 |
| 6,435,369 | B1 | 8/2002 | Poursayadi | |
| 6,457,684 | B1 * | 10/2002 | McKendry | 248/127 |
| 6,560,906 | B1 | 5/2003 | Hillstrom | |
| 6,606,809 | B2 | 8/2003 | Hillstrom et al. | |
| 6,659,681 | B1 | 12/2003 | Kulp et al. | |
| 6,688,028 | B2 * | 2/2004 | Backe | 40/612 |
| 6,752,582 | B2 | 6/2004 | Garcia | |
| 6,928,952 | B2 | 8/2005 | Garcia | |
| 2005/0091895 | A1 | 5/2005 | Garcia | |
| 2006/0048421 | A1 * | 3/2006 | Oleksak | 40/610 |

* cited by examiner

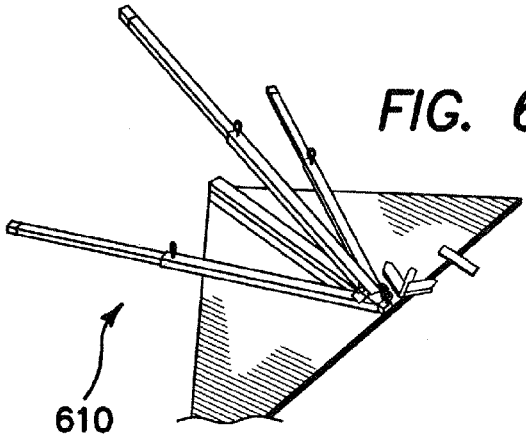
FIG. 6A
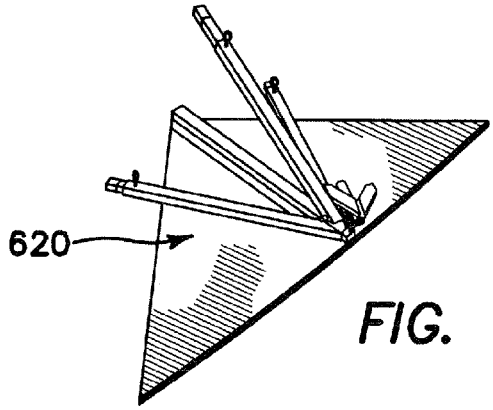
FIG. 6B
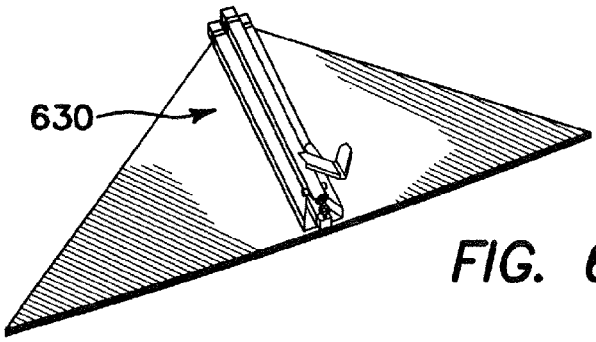
FIG. 6C
FIG. 6D
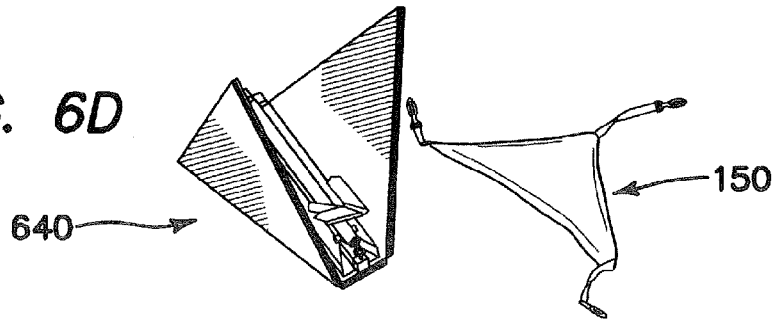

FOLDABLE TRAFFIC SIGN

This application claims the benefit under 35 U.S.C. 119(e) of the filing date of Provisional U.S. Application Ser. No. 60/666,816, entitled Foldable Traffic Sign, and filed on Mar. 30, 2005, which application is expressly incorporated herein by reference.

BACKGROUND OF THE INVENTION

The present invention relates generally to traffic signs, and more particularly to rigid traffic signs that can be folded to a smaller size.

Of major importance today, due to our society's dependence upon motorized transportation, is the continuing construction, repair, and maintenance of freeways, highways, and roads. Involved in all such construction, repair, and maintenance are traffic signs for placement on the roadside ahead of the job site, where motorists can be warned of the presence of road construction equipment, personnel, or hazardous conditions as they approach the work site. To provide motorists with such notification or warning, it is necessary that one or more traffic signs be displayed along the roadside, such signs being located well in advance of the road construction or repair project. One type of traffic sign that is commonly placed along the roadside is a rigid sign typically made out of one piece of wood, aluminum, or corrugated plastic. A worker has to carry around this large rigid sign, sometimes 36"×36", but more often 48"×48". This sign can not only be heavy, but also can block a worker's view of traffic. Moreover, the large sign can act as a kite, posing additional danger to the worker, particularly in windy conditions or near fast passing vehicles. Additionally, storage of rigid signs consumes a lot of space, both for the large signs and their corresponding sign stands. The large signs are also more susceptible to damage, such as corners getting bent or broken, or the reflective front surface getting scratched. Accordingly, there is a need in the art to develop new signs that overcome the current problems of these large and rigid signs.

SUMMARY OF THE INVENTION

The present invention comprises a traffic safety sign system that can be folded into a neat package and conveniently carried or stored.

More particularly, in one aspect of the invention there is provided a foldable traffic sign system, which comprises a relatively rigid sign panel and a plurality of folding lines disposed in the sign panel, for permitting ready folding of the sign panel into a substantially smaller configuration. In a preferred embodiment, at least one cut is disposed partially along a dimension of the sign panel, to further facilitate ready folding of the sign panel. One of the folding lines is disposed substantially horizontally across a center region of the sign panel, and at least one of the folding lines is disposed substantially vertically on the sign panel, and intersects with the horizontal folding line. The plurality of folding lines creates a plurality of sign sections, preferably six, defined by a combination of the folding lines and cuts in the sign panel.

The inventive sign system further comprises a sign stand for supporting the foldable sign panel. The sign stand preferably comprises a bracket disposed at an upper end thereof for releasably retaining upper portions of the sign panel when the sign panel is to be in a deployed configuration. The bracket is pushed downwardly to retain the sign panel in the deployed configuration, and is moved upwardly to release the sign panel for folding and storage or transport. The sign stand further comprises a two-piece telescoping mast.

A tote, such as a bag, is provided for containing the sign system, including the sign panel, mast, and optionally, a ballast.

In another aspect of the invention, there is disclosed a method of disassembling and storing a sign system, which comprises a step of releasing a top end of a deployed relatively rigid sign panel from a sign stand. An upper portion of the sign panel is folded over a lower portion of the sign panel, and a side portion of the sign panel is folded over another side portion of the sign panel. It is noted that these folding steps could potentially take place in different sequences. The sign panel is then placed into a tote for storage and/or transport.

The invention, together with additional features and advantages thereof, may best be understood by reference to the following description taken in conjunction with the accompanying illustrative drawing.

BRIEF DESCRIPTION OF THE DRAWINGS

FIGS. 6A-6D are sequential views showing steps of folding up and preparing the sign of the invention for storage and/or transport.

DESCRIPTION OF THE PREFERRED EMBODIMENT

Figure 1A:
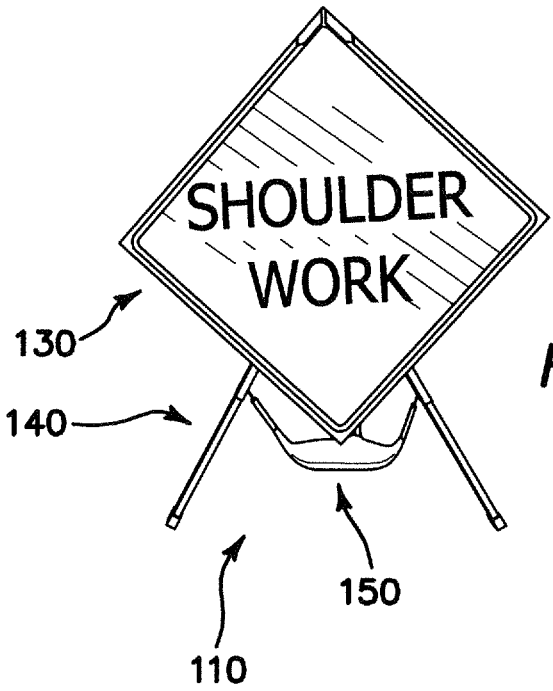
FIG. 1A is a front view showing one embodiment of a foldable traffic sign constructed in accordance with the principles of the present invention.
Figure 1B:
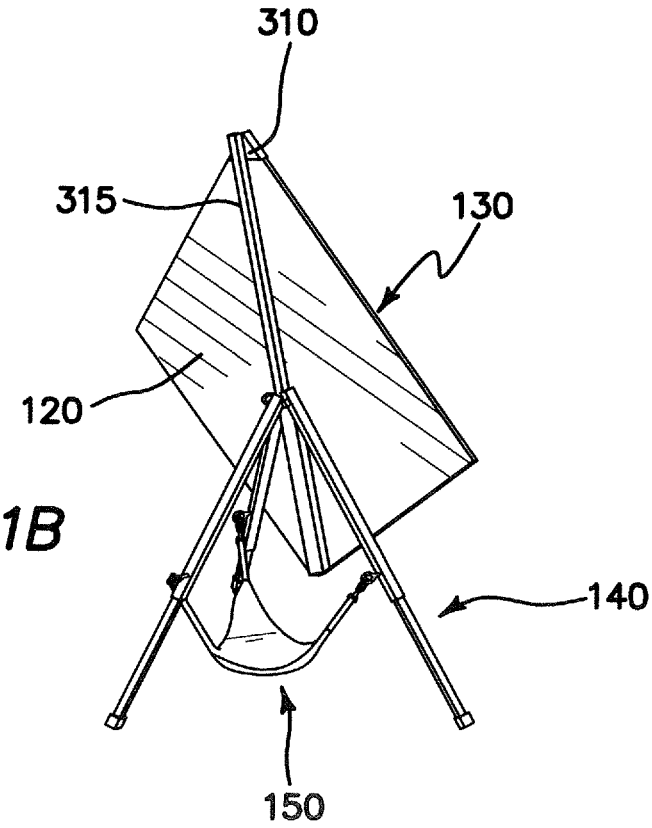
FIG. 1B is a rear view of the sign of FIG. 1A.

The present invention is a traffic sign that can be folded into a neat package and conveniently carried or stored. In FIGS. 1A and 1B, there is shown a front side 110 and a rear side 120 of a traffic sign 130 in accordance with the present invention. The sign 130, fully deployed, is a rigid sign. However, the sign 130 of the present invention differs from conventional rigid signs in that it is made from a relatively light and rigid material, such as plastic, and includes folds and/or cuts patterned therein to facilitate readily folding the sign 130 into a smaller package. In one embodiment, the sign is made from a corrugated plastic having a thickness of about ¼ inch to ¾ inch. In a preferred embodiment, this thickness is about ½ inch. No matter what type of material is used to fabricate the sign 130, a key requirement of the material is that it be amenable to the creation of folding lines therein. In an alternative embodiment, the folds can be replaced with hinges, as long as the hinges facilitate the process of folding up the sign 130 into a convenient package.

As shown in FIGS. 1A and 1B, the sign 130 may be attached to a stand 140 for ease of assembly, disassembly, and storage, but can also be removed from the sign stand in order to change the sign 130 because of damage thereto, or because of a desire to change the sign's message. In a preferred embodiment, the stand 140 is a tripod, with foldable and retractable legs. A sandbag 150, or other suitable ballast, of varying weights, may be employed as shown, and disposed on or attached to the legs of the stand 140 in order to lower the center of gravity of the sign 130 and to thus enhance stability.

An important advantage of employing a folding sign 130 is to create a small package, including the stand. To that purpose, as shown particularly in FIG. 2, the sign 130 includes folding line 210 disposed across a center of the sign, and folding lines 220 and 222 disposed vertically on the sign, from lower ends of the sign to the folding line 210, as shown. The folding lines 210, 220, 222 may be formed by several methods, including pressing heat shrinking, injection molding, or other methods known in the art for creating lines of weakness or folds in materials. The fold 210 permits sections 212, 234 and 214 to be folded over sections 216, 224, and 218, respectively. Fold 220 allows section 216, and, indirectly, section 212, of sign 130 to be folded over. Fold 222 allows section 218, and, indirectly, section 214, of sign 130 to be folded over. The indirect folding of sections 212 and 214 is caused by the fact that the sign 130 further includes two cuts 230, 232 which separate section 234 from sections 212 and 214. The cuts 230 and 232 promote folding of the other sections, particularly when the thickness of the sign material increases, as will be described in more detail below. At smaller thicknesses of the sign material, it is possible to avoid cuts 230 and 232, and simply have folding lines disposed in their place, as long as these folds to not prevent the folding process as described below. The relative position of folds 220 and 222, and therewith cuts (or folds) 230 and 232, is around the midline of sign 130 with a width of about 2-6 inches. The width is selected such that the stand and other items that are folded with the sign easily fit as will become clear to a person of average skill in the art.

Figure 2:
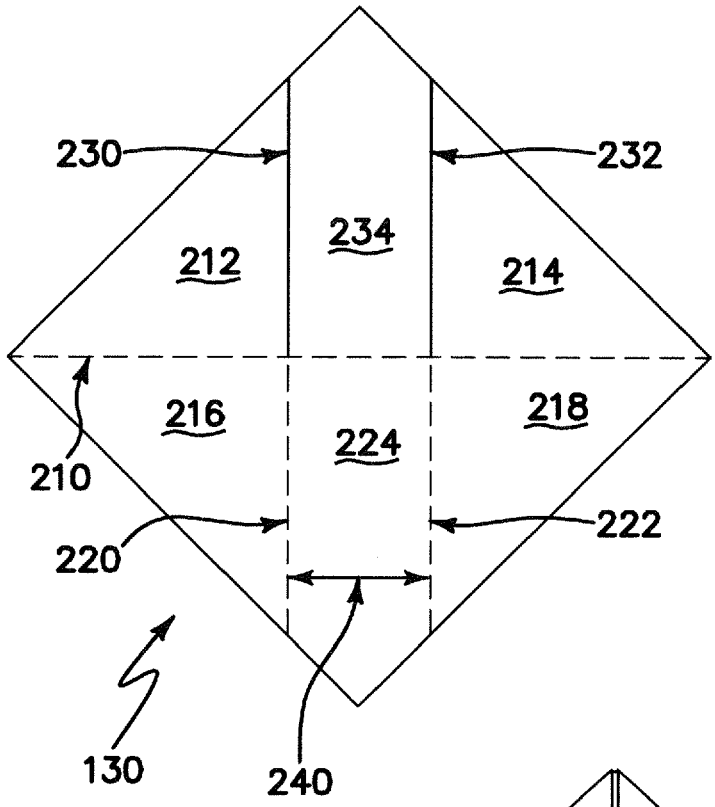
FIG. 2 is a schematic view of the sign of FIGS. 1A and 1B, showing an example of folding and cutting lines in accordance with the invention.
Figure 3:
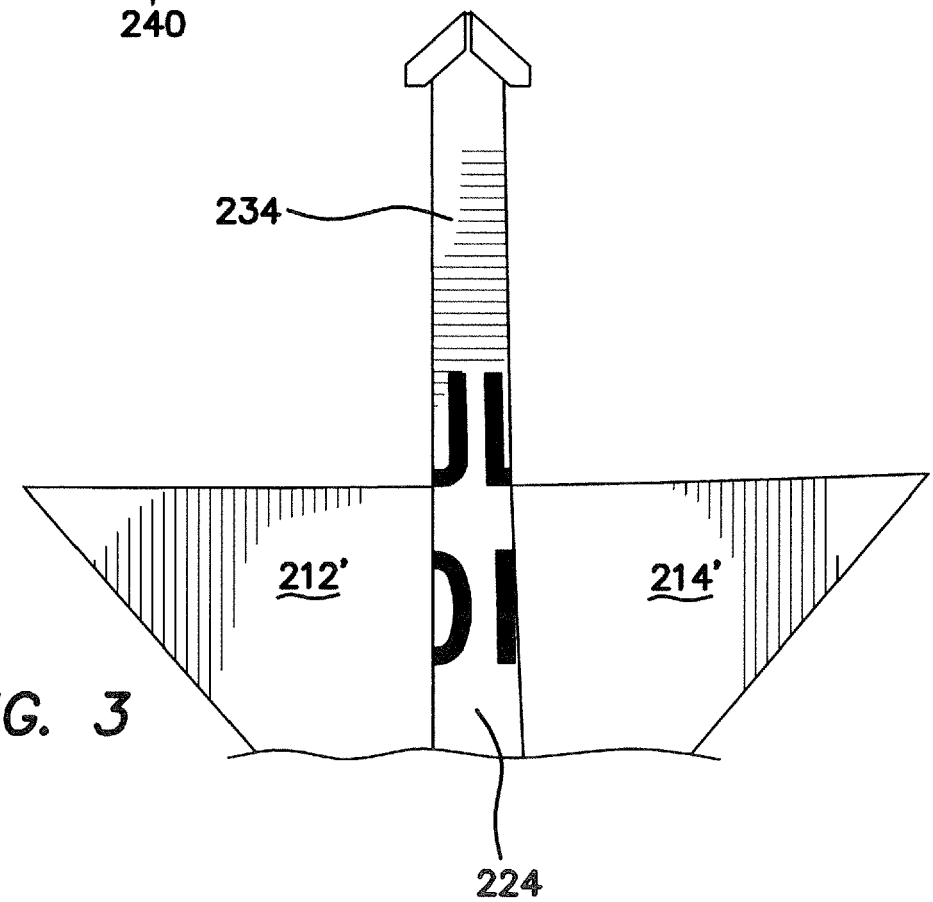
FIG. 3 is a front view of the sign of FIGS. 1A and 1B, wherein the sign is partially folded along folding lines shown in FIG. 2.

The remaining figures illustrate a method of folding up and stowing the sign 130. It is noted that a reverse method is employed to unfold and deploy the sign. In FIG. 3, there is shown a holding bracket or latch 310 that keep in place sections 212, 234, and 214 when the sign is unfolded and deployed. The holding bracket 310 keeps in place the three sections whereby all six sections of the sign 130 create a completely unfolded sign, as shown in FIGS. 1 and 2. To accomplish this latching function, the three sections are folded upwardly about folding line 210, and the converging corners of these three sections are disposed beneath the upper portion of the bracket. The bracket 310 can be pushed downwardly to lock it in place, or pulled upwardly to unlock the sections and permit them to drop downwardly for folding purposes. In other embodiments, the bracket 310 may comprise a clamping mechanism, a squeezing mechanism, or any type of other mechanism which can keep the three sections together at the upper end of the sign stand 140 and can also be readily undone. It is noted that the bracket 310 is adapted to be slid over and locked onto a mast 315 (FIG. 1B) of the sign stand 140.

Figure 4:
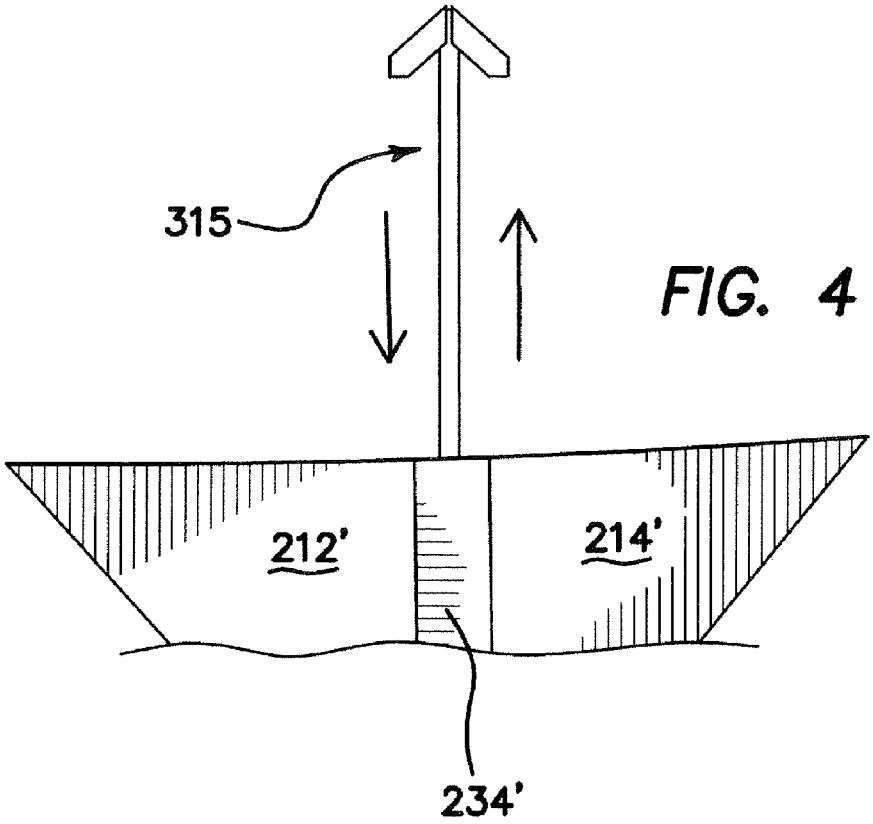
FIG. 4 is a front view similar to FIG. 3 showing a different folded configuration.
Figure 5:
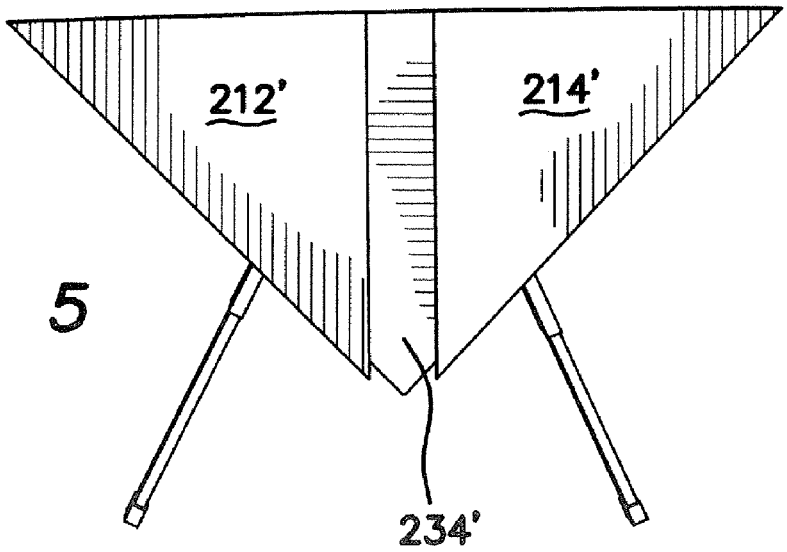
FIG. 5 is a front view similar to FIGS. 3 and 4, showing yet another different folded configuration.

When the holding bracket 310 is actuated to release the top ends of the sign sections 212, 214, 234, these sections can be folded downwardly, as shown in FIGS. 3 and 4. Section 212 is folded down to face section 216, and thus show its back face 212'. Section 214 is folded down to face section 218, and thus show its back face 214'. Section 234 is folded down to face section 224, and thus show its back face 234' (FIGS. 4 and 5). Mast 315 of the sign stand 140 is preferably a two-piece telescoping mast, of a type known in the sign stand art, and can be adjusted in height to fit the sign. When the traffic sign 130 is being folded up, the mast 315 is shortened by telescoping the two mast sections together, as shown in FIG. 5. The bracket 310 can be removably attached to the top end of the mast 315, or alternatively, it can be permanently affixed to the top of the mast as long as it fits into the space created by the folded sections.

FIGS. 6A-6D illustrate a method of folding up the stand 140. Steps 610 and 620 illustrate pushing in the retractable legs of the stand 315. Step 630 (FIG. 6C) illustrates a step of folding the retracted legs. Step 640 (FIG. 6D) illustrates a step of packaging the folded sign around the folded stand.

Figure 7A:
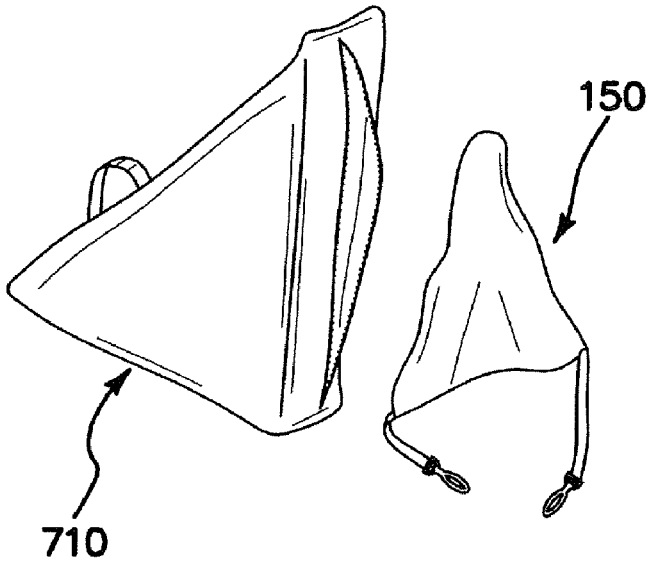
FIGS. 7A and 7B are sequential views illustrating final steps of placing the folded sign into a convenient carrying tote.
Figure 7B:
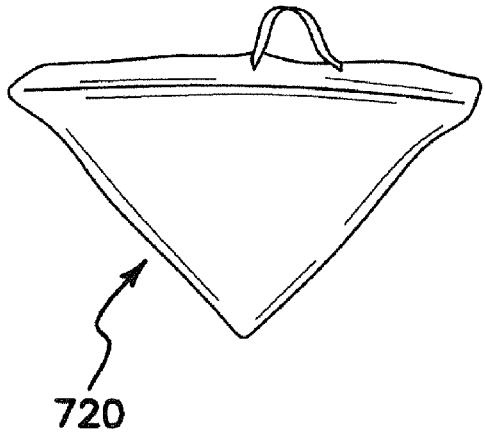

FIG. 7A shows a step of placing the folded sign and stand, optionally with the sandbag 150, in a tote 710, that can be easily carried, as shown by step 720 in FIG. 7B.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A foldable traffic sign system, comprising:

a relatively rigid sign panel having a plurality of folding lines therein for permitting ready folding of the sign panel into a substantially smaller configuration;

a sign stand comprising a two-piece telescoping mast and a plurality of folding legs for supporting said sign panel;

a clamping mechanism disposed on said mast for selectively securing or releasing a top edge of said sign panel, wherein the clamping mechanism secures said top edge in an upright orientation when said sign panel is being placed in a deployed configuration, and releases said top edge to a folded orientation when said sign panel is being placed in an undeployed configuration;

said plurality of folding lines being arranged so that said sign panel, in its undeployed configuration is configured in a generally triangular shape, with a hollow center portion within which said sign stand in a folded configuration may be disposed; and a generally triangular shaped tote bag which is sized for containing both said folded sign panel and said folded sign stand, disposed within the hollow center portion formed by said folded sign panel.

2. The sign system as recited in claim 1, and further comprising at least one cut disposed partially along a dimension of the sign panel, to further facilitate ready folding of the sign panel.

3. The sign system as recited in claim 1 wherein one of said folding lines is disposed substantially horizontally across a center region of the sign panel.

4. The sign system as recited in claim 3, wherein at least one of said folding lines is disposed substantially vertically on said sign panel, and intersects with said horizontal folding line.

5. The sign system as recited in claim 1, wherein the plurality of folding lines creates a plurality of sign sections defined by said folding lines.

6. The sign system as recited in claim 5, wherein six sign sections are formed by a combination of folding lines and cuts in said sign panel.

7. The sign system as recited in claim 1, wherein said clamping mechanism comprises a bracket slidably disposed on said mast.

8. The sign system as recited in claim 7, wherein said bracket is pushed downwardly to retain the sign panel in said deployed configuration, and is moved upwardly to release the sign panel for folding and storage or transport.

9. The sign system as recited in claim 1, wherein said sign panel is diamond-shaped.

10. The sign system as recited in claim 9, wherein said plurality of folding lines comprises a horizontal folding line extending across a center of said sign panel, between two opposed corners thereof, and two vertical horizontally spaced folding lines extending at least from said horizontal folding line to lower edges of said sign panel.

* * * * *